United States Patent [19]

Shimazaki

[11] 4,240,389

[45] Dec. 23, 1980

[54] AIR-FUEL RATIO CONTROL DEVICE FOR AN INTERNAL COMBUSTION ENGINE

[75] Inventor: Ruji Shimazaki, Susono, Japan

[73] Assignee: Toyota Jidosha Kogyo Kabushiki Kaisha, Toyota, Japan

[21] Appl. No.: 907,339

[22] Filed: May 18, 1978

[30] Foreign Application Priority Data

Feb. 15, 1978 [JP] Japan ..... 53/15340

[51] Int. Cl.[3] ..... F02B 75/10

[52] U.S. Cl. ..... 123/492; 123/440

[58] Field of Search ..... 123/32 EH, 119 EC, 32 EE

[56] References Cited

U.S. PATENT DOCUMENTS

| | | | |
|---|---|---|---|
| 3,727,591 | 4/1973 | Suda | 123/32 EH |
| 4,064,844 | 12/1977 | Matsumoto et al. | 123/32 EH |
| 4,075,982 | 2/1978 | Asano et al. | 123/32 EH |
| 4,089,313 | 5/1978 | Asano et al. | 123/32 EH |
| 4,109,615 | 8/1978 | Asano | 60/276 |
| 4,119,072 | 10/1978 | Asano | 60/276 |
| 4,121,547 | 10/1978 | Asano | 123/119 EC |
| 4,129,109 | 12/1978 | Matsumoto | 123/32 EH |
| 4,131,089 | 12/1978 | Fujishiro et al. | 60/276 |
| 4,153,023 | 5/1979 | Asano et al. | 60/276 |

*Primary Examiner*—Charles J. Myhre
*Assistant Examiner*—Raymond A. Nelli
*Attorney, Agent, or Firm*—Stevens, Davis, Miller & Mosher

[57] ABSTRACT

Disclosed is an air-fuel control device for an internal combustion engine which includes: an $O_2$ sensor for detecting the oxygen concentration of exhaust gas; a control circuit having a comparator for comparing the output voltage from the $O_2$ sensor with a reference voltage ($V_R$), so that the air-fuel ratio of the mixture discriminated as rich or lean with respect to a stoichiometric air-fuel ratio, and; an installation for supplying fuel into an intake passage, so that when the air-fuel ratio of the mixture is leaner than the stoichiometric value the amount of fuel is increased and when the air-fuel ratio of the mixture is richer than the stoichiometric value the amount of fuel is decreased. This device further includes a sensor for detecting the accelerating operating conditions of the engine, and a mechanism for changing the reference voltage ($V_R$) to a value ($V_{R2}$) different from a predetermined value ($V_{R1}$) so that the air-fuel ratio of the mixture is changed so as to be richer only when the engine is in the accelerating operating conditions.

4 Claims, 5 Drawing Figures

AIR-FUEL RATIO CONTROL DEVICE FOR AN INTERNAL COMBUSTION ENGINE

BACKGROUND OF THE INVENTION

This invention relates to air-fuel ratio control device for an internal combustion engines, and more particularly relates to an air-fuel ratio control device for reducing noxious elements contained in the exhaust gas being discharged from the internal combustion engines.

A three-way catalytic converter system is known as a device for diminishing simultaneously three different noxious gases, carbon-monoxide (CO), hydrocarbon (HC) and nitrogen oxides ($NO_x$), being exhausted from an internal combustion engine. A three-way catalytic convertor is provided in an exhaust pipe and has a characteristic that, when the composition of the exhaust gas being introduced into the three-way catalytic converter is in an extremely narrow range in the vicinity of the composition of the exhaust gas produced by the combustion of the mixture having a stoichiometric air-fuel ratio, the oxidization of CO and HC and the reduction of $NO_x$ are simultaneously performed, which causes simultanious diminishing of these three noxious components. Therefore, if the three-way catalytic converter is used, it is necessary to control the ratio of the amount of air being introduced into the upstream side of the three-way catalytic converter to the amount of fuel being introduced into the upstream side of the three-way catalitic converter (hereinafter refered as the total air-fuel ratio) so that it conforms to the stoichiometric air-fuel ratio. The stoichiometric air-fuel ratio means the air-fuel ratio at which a three-way catalytic converter effectively purifies the three noxious elements, CO, HC and $NO_x$, simultaneously.

There is a feed-back type air-fuel control system known in the art, which comprises: means for detecting the oxygen concentration of exhaust gas, such as an $O_2$ sensor provided in an exhaust pipe; a computer means to which the output of the $O_2$ sensor is input and in which the output voltage is compared with a reference voltage, and; an actuator means for supplying additional fuel or air and controlling the total air-fuel ratio in accordance with the comparing signal from the computor means, so that the total air-fuel ratio is kept in the vicinity of the stoichiometric air-fuel ratio. In these air-fuel control systems, when the $O_2$ sensor detects a lean air-fuel ratio, the amount of additional fuel is controlled so as to be increased (or the amount of additional air is controlled so as to be decreased), and when the $O_2$ sensor detects a rich air-fuel ratio, the amount of additional fuel is controlled so as to be decreased (or the amount of additional air is controlled so as to be increased). Therefore, the total air-fuel ratio of the exhaust gas being introduced into the three-way catalytic converter is controlled so as to be maintained in the vicinity of the stoichiometric air-fuel ratio.

However, in a conventional air-fuel ratio control device in which additional fuel is controlled as described above, there are some drawbacks. For example, there is a time delay in response, caused for instance by the means for detecting the oxygen concentration of the exhaust gas, or in other words, a time interval from the changing of the air-fuel ratio of the mixture in an intake system or in an exhaust system to the detecting of the oxygen concentration of the exhaust gas in an exhaust system downstream of the position in which the air-fuel ratio is changed. Consequently, the increasing of the supply of the additional fuel or decreasing of the supply of the additional air does not immediately respond to increase of the suction air when the engine is in the accelerating operating conditions, and thus, the controlled air-fuel ratio is shifted to the leaner side of the stoichiometric air-fuel ratio. During the time the engine is operating in an accelerating condition, the $NO_x$ emission is increased because the amount of suction air is increased. In addition, in an internal combustion engine having an exhaust gas recirculation system, hereinafter referred simply as an EGR system, by which a part of exhaust gas is recirculated into an intake passage in order to reduce $NO_x$ emission, exhaust gas recirculation is performed during the time the air-fuel ratio is lean, which causes a reduction of the operating efficiency of the internal combustion engine.

Some solutions have been proposed for compensating for the gap between a controlled air-fuel ratio and a stoichiometric air-fuel ratio in the prior art air-fuel ratio control systems. Some of these solutions are: a solution in which a proportion constant or an integration constant of the feed back control loop is selected to be a prescribed value in a control circuit (for instance, disclosed in Japanese Laid Open Patent Publication No. Sho. 52-60338); a solution in which the output from a comparator in a control circuit is delayed in accordance with the operating conditions of an engine (for instance, disclosed in Japanese Laid Open Patent Publication No. Sho. 51-146638), and; a solution in which at least one of a proportion constant and an integration constant is changed in a control circuit in accordance with the operating condition of the engine (for instance, disclosed in Japanese Laid Open Patent Publication No. Sho. 51-117231). However, in these air-fuel control devices known from the prior art, it is not easy to keep the controlled air-fuel ratio in the vicinity of the stoichiometric air-fuel ratio, especially during the time the engine is operating in an accelerating condition, which causes a lean air-fuel ratio of the mixture, and thus the efficiency of purification of $NO_x$ contained in exhaust gas is not high.

SUMMARY OF THE INVENTION

An object of this invention is to provide an air-fuel ratio control device for an internal combustion engine in which the air-fuel ratio is controlled so as to be in the vicinity of a stoichiometric air-fuel ratio by preventing the air-fuel ratio of mixture from becoming a lean air-fuel ratio during accelerating operating conditions, so that the efficiency of purification of exhaust gas will not be decreased.

Another object of this internal combustion engine having an EGR system in which the operating efficiency of the engine is not decreased during accelerating operating conditions.

According to the present invention, there is provided an air-fuel ratio control device for an internal combustion engine which comprises: a first sensor provided in an exhaust passage for detecting the oxygen concentration of the exhaust gas; a control circuit having means for comparing the output voltage from said first sensor with a reference voltage, so that the air-fuel ratio of the mixture being introduced into the internal combustion engine is discriminated as rich or lean with respect to a stoichiometric air-fuel ratio; means for adjusting the fuel supplied into the internal combustion engine so that when the air-fuel ratio of the mixture is leaner than the stoichiometric air-fuel ratio the amount of fuel is increased and when the air-fuel ratio of the mixture is richer than the stoichiometric air-fuel ratio the amount of fuel is decreased; a second sensor for detecting the accelerating operating conditions of the internal combustion engine, and; means for changing said reference voltage to a value different from a predetermined value so that the air-fuel ratio of the mixture being controlled is changed so as to be richer only when the internal combustion engine is in the accelerating operating conditions.

Preferably, the first sensor for detecting the oxygen concentration of exhaust gas is a so-called $O_2$ sensor.

According to an embodiment of this invention, the comparing means of the control circuit comprises: a comparator to which the output voltage of the first sensor and the reference voltage are input, and; a variable resistance for changing said reference voltage being input into said comparator, the resistance value of said variable resistance being changed by said reference voltage changing means.

According to another embodiment of this invention, the comparing means of the control circuit comprises a first comparator to which a reference voltage ($V_{R1}$) for ordinary conditions is input and a second comparator to which a reference voltage ($V_{R2}$) for accelerating conditions different from $V_{R1}$ is input, and said reference voltage changing means selects one of said first and second comparators.

The second sensor for detecting the accelerating operating conditions preferably comprises a diaphragm-type air valve having a diaphragm which is actuated by vacuum pressure drawn from the intake passage downstream of a throttle valve, said diaphragm-type valve sends an accelerating signal to the control circuit when the absolute value of intake vacuum pressure is abruptly reduced.

DETAILED DESCRIPTION OF THE PREFERRED EMBODIMENTS

Figure 1:
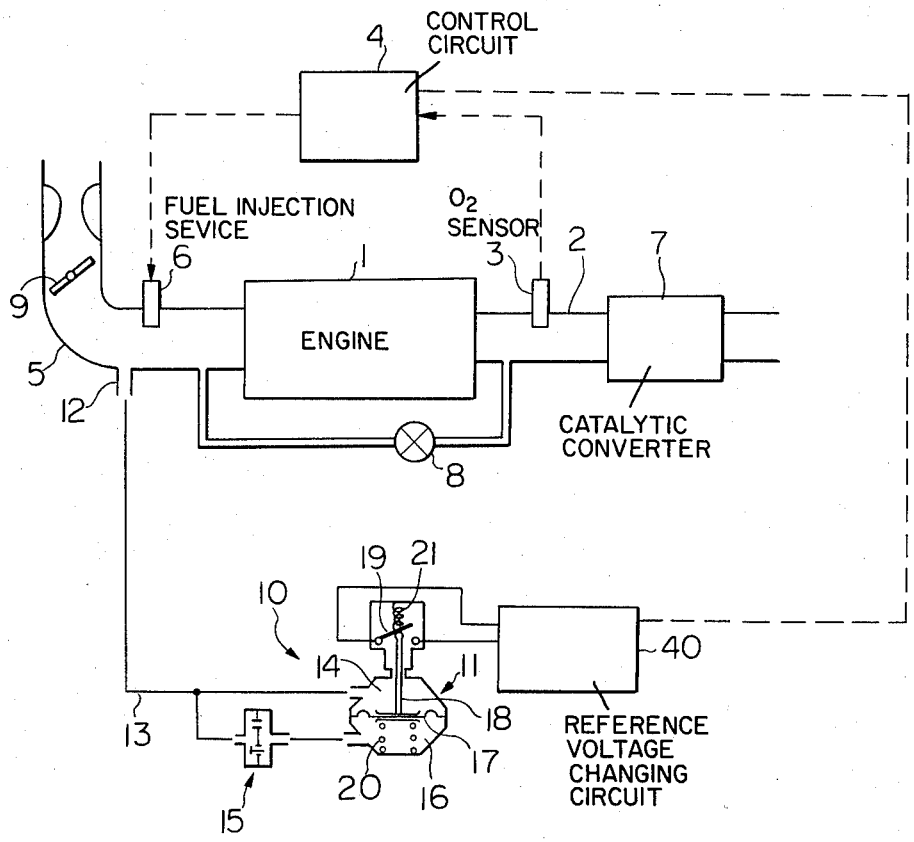
FIG. 1 is a schematic view of an internal combustion engine including an air-fuel ratio control device of this invention.

Referring now to FIG. 1, an internal combustion engine 1 has an exhaust passage 2 having an oxygen detecting means, such as an $O_2$ sensor 3, for detecting the oxygen concentration of exhaust gas. It is well known that the total air-fuel ratio of the exhaust gas being introduced into a three-way catalytic converter can be discriminated as lean or rich with respect to a stoichiometric air-fuel ratio by detecting the oxygen concentration of the exhaust gas. The output of the $O_2$ sensor is input into a control circuit 4, through which an additional fuel supply device 6, such as an injection device, for injecting fuel for compensation, hereinafter referred to simply as an actuator, provided in an intake passage 5 is actuated. Thus, additional fuel is supplied by the actuator 6 in order to keep the air-fuel ratio of the mixture being supplied into the engine in the vicinity of the stoichiometric air-fuel ratio. A three-way catalytic converter 7 is provided in the exhaust passage 2 downstream of the $O_2$ sensor 3, which converter simultaneously purifies three noxious components, CO, HC and $NO_x$, contained in the exhaust gas. In the internal combustion engine illustrated in FIG. 1, there is provided an EGR system which recirculates a part of exhaust gas drawn from the exhaust passage 2 into the intake passage 5, through an EGR pipe line having an EGR valve 8 which controls the amount of EGR.

The air-fuel control device of this invention has a means for detecting accelerating operating conditions of the engine. In the embodiment illustrated in FIG. 1, the acceleration detecting device 10 comprises a diaphragm-type valve 11 having a diaphragm 17 being actuated by vacuum pressure. A vacuum port 12 is provided in the intake passage 5 downstream of a throttle valve 9, actually at the intake manifold of the engine, and is communicated through a passage 13 with a first chamber 14 of the diaphragm valve 11. The vacuum port 12 is also communicated to a second chamber 16 through a vacuum delay valve 15 and a bypass line in a branch of the passage 13. A rod 18 is operationally connected to the diaphragm 17 which partitions the first chamber 14 from the second chamber 16. The upward or downward movements of the rod 18 turns off or on an acceleration switch 19. When the internal combustion engine is operating under normal conditions, that is to say, at constant load conditions, the pressure in the first chamber 14 is the same as that in the second chamber 16. Therefore, the rod 18 pushes the acceleration switch 19 upwardly by the help of a spring 20, and the switch 19 is turned off. When load of the internal combustion engine is increased abruptly, that is to say, during accelerating operating conditions, the vacuum pressure in the intake passage is abruptly decreased. During such conditions, because only the second chamber 16 is maintained at high vacuum pressure during a predetermined time interval through the action of the vacuum delay valve 15, the rod 18 is moved downwardly against the spring 20 by the vacuum pressure in the second chamber 16, and the switch 19 is turned on. The signal from the acceleration switch 19 is input into a reference voltage changing circuit 40, as described hereinafter with reference to FIG. 2.

The embodiment with the acceleration detecting device 10, described above, comprises diaphragm valve 11 having a diaphragm 17 being actuated by the intake vacuum pressure. However, acceleration detecting devices of other types known in the art can also be adopted. For example there may be adopted: a type which comprises a sensor for detecting the opening degree of a throttle valve and for sending a signal when the throttle valve turns a predetermined number of degrees toward the opened position in a predetermined time interval; a type which comprises an air-flow meter provided in an intake passage at the upstream side of a throttle valve for detecting the amount of suction air and for sending a signal when the rate of increase of suction air is over a predetermined value, and; a type which comprises a sensor for detecting the running speed of a vehicle or for detecting the rate of engine rotating speed.

Figure 2:
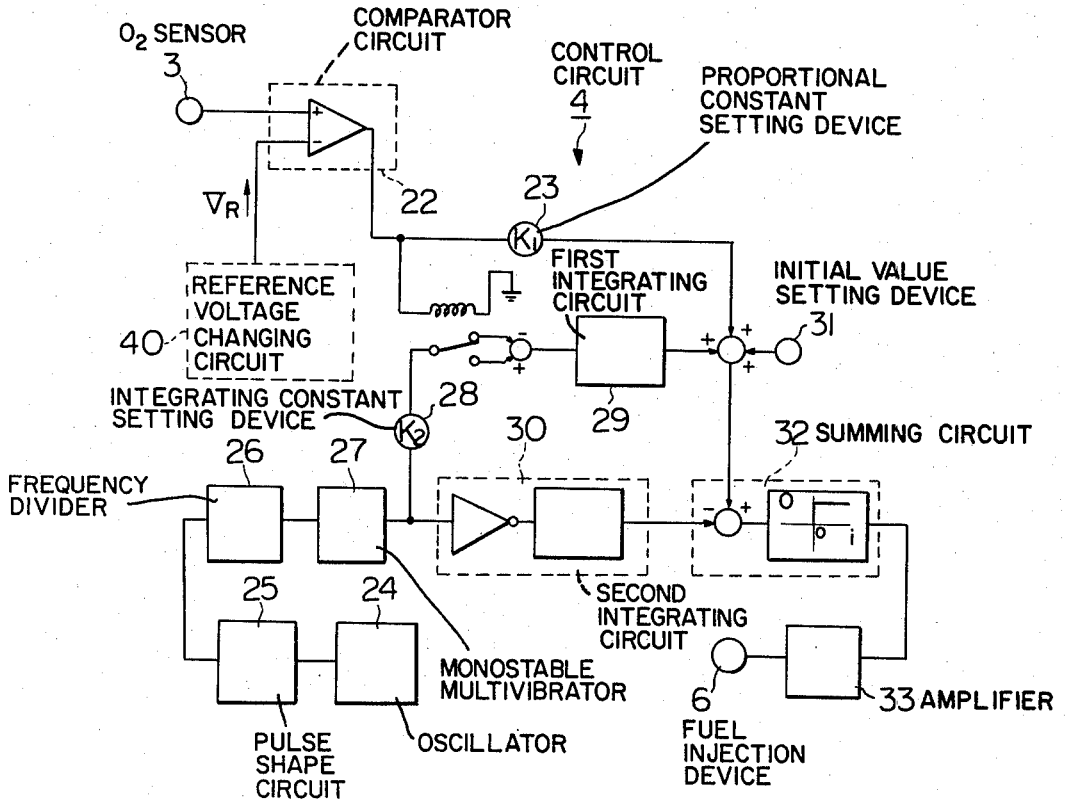
FIG. 2 is a block diagram of a control circuit used in an air-fuel ratio control device of this invention.

FIG. 2 is a block diagram of the control circuit 4 used in the air-fuel ratio control device of this invention. The output from the $O_2$ sensor 3 and a reference voltage $V_R$ from the reference voltage changing circuit 40 are input into a comparator circuit 22. The output of the comparator circuit 22 is input into a proportional constant setting device 23. The output of an oscillator 24 is input through a pulse shape circuit 25 and a frequency divider 26 into a monostable multivibrator 27. One of the outputs of the monostable multivibrator 27 is input through an integrating constant setting device 28 into a first integrating circuit 29. The output of the first integrating circuit 29, as well as the output of the afore-mentioned proportional constant setting device 23 and the output of an initial value setting device 31, is input into summing circuit 32. The other of the outputs of the monostable multivibrator 27 is input through a second integrating circuit 30 into the summing circuit 32, the output of which is input through an amplifier 33 into the above-mentioned actuator 6. Although the oscillator 24 is provided in the control circuit illustrated in FIG. 2, a control system may also be used in place of the oscillator 24, in which system an ignition pulse is directly input into the pulse shape circuit 25.

Figure 3:
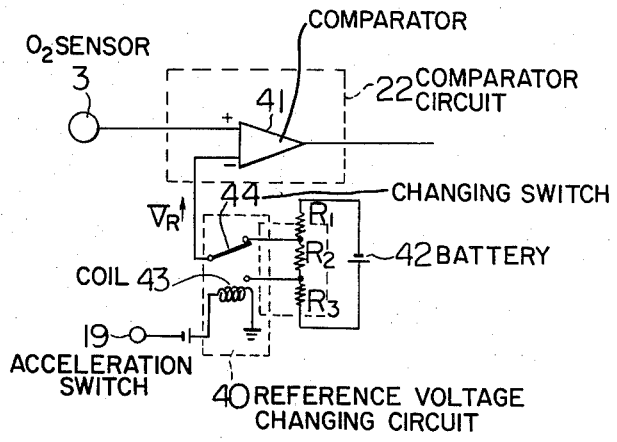
FIG. 3 is a schematic diagram of a comparator circuit and a comparative voltage changing circuit in a control circuit of an embodiment of this invention.
Figure 4:
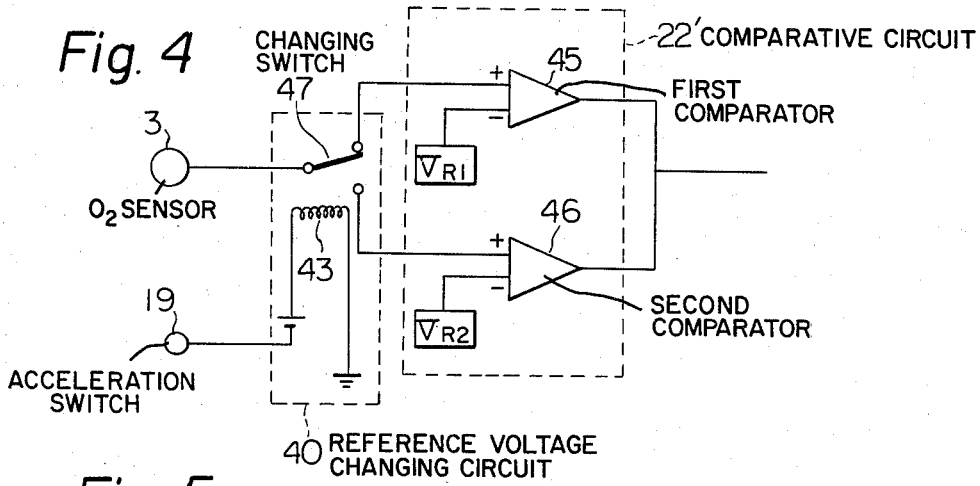
FIG. 4 is a schematic diagram of a comparator circuit and a comparative voltage changing circuit in a control circuit of another embodiment of this invention.

FIGS. 3 and 4 illustrate embodiments of a comparative circuit 22 and a reference voltage changing circuit 40. In FIG. 3, a comparative circuit 22 comprises a comparator 41, into which the output from the $O_2$ sensor 3 and a reference voltage are input. Resistances R1, R2 and R3 which cooperatingly define the value of the reference voltage ($V_R$) are connected to a battery 42 as illustrated in FIG. 2. The accelerating switch 19 is connected to a coil 43. When the coil 43 is excited, a changing switch 44 turns and changes the value of reference voltage ($V_R$). The reference voltage $V_R$ is input to the comparator 41.

In FIG. 4, a comparative circuit 22' comprises two comparators 45 and 46. A normal reference voltage $V_{R1}$ is input into the first comparator 45 and an accelerating reference voltage $V_{R2}$, which is higher than $V_{R1}$, is input into the second comparator 46 arranged parallel to the first comparator 45. The $O_2$ sensor 3 is connected to a changing switch 47. An accelerating switch 19 is connected to a coil 43 in the same manner as described with reference to FIG. 3. When the coil 43 is excited, the changing switch 47 turns its position so that one of the comparators 45 and 46 is selected.

Figure 5:
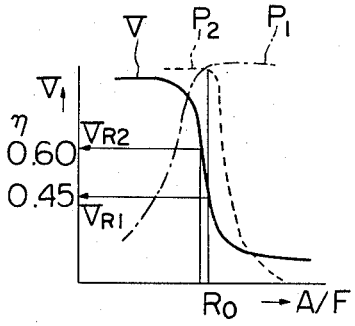
FIG. 5 is a diagram illustrating the relationship between air-fuel ratio of the mixture, the output voltage of the $O_2$ sensor and the ratio of purification of the three elements, CO, HC and $NO_x$.

The operation of the air-fuel ratio control device of this invention will now be described. In the embodiments described above, since an $O_2$ sensor is used as a detecting means for detecting the oxygen concentration of the exhaust gas, the relationships between the air-fuel ratio of the mixture, the voltage of the $O_2$ sensor and the purification rate of the three components, CO, HC and $NO_x$, are indicated as illustrated in FIG. 5. In FIG. 5, A/F indicates the air-fuel ratio of the mixture, a solid line curve V indicates the voltage of the $O_2$ sensor, a dotted line curve $P_1$ indicates the purification rate of oxidizing elements CO and HC, and a broken line curve $P_2$ indicates the purification rate of deoxidizing element $NO_x$. In a conventional air-fuel ratio control device, the position in the diagram at which a high purification rate for the three elements can be obtained, that is to say, at the point where the curve $P_1$ intersects the curve $P_2$, defines the stoichiometric air-fuel ratio, and; the output voltage at the stoichiometric air-fuel ratio in the diagram is defined as a reference voltage $V_{R1}$ being input into the comparative circuit 22. The reference voltage $V_{R1}$ is usually 0.35 to 0.45 V.

In the air-fuel ratio control device of this invention, during ordinary engine operating conditions, the reference voltage $V_{R1}$ being input into the comparative circuit 22 is defined to be 0.35 to 0.45 V, for instance 0.45 V, in the same manner as in a conventional air-fuel ratio control device. During accelerating engine operating conditions, however, the reference voltage being input into the comparative circuit 22 is defined to be $V_{R2}$, for instance 0.60 V, which is higher in value than the reference voltage $V_{R1}$, for ordinary engine operating conditions.

During ordinary engine operating conditions, therefore, the output from the $O_2$ sensor 3 is compared with the ordinary reference value $V_{R1}$ in the comparative circuit 22. The circuit 22 outputs a high level signal when the output from the $O_2$ sensor 3 is higher in value than the ordinary reference voltage $V_{R1}$, that is to say, when the air-fuel ratio of the mixture is rich. The circuit 22 outputs a low level signal when the output from the $O_2$ sensor 3 is lower in value than the ordinary reference voltage $V_{R1}$, that is to say, when the air-fuel ratio of the mixture is lean. The output of the comparative circuit 22 is input into the proportional constant setting device 23, in which a proportional constant is determined. On the other hand, the signal from the oscillator 24 is input into the pulse shape circuit 25, by which the wave form of the signal is arranged, and then is input into the monostable multivibrator 27, in which the timing for actuation of the actuator 6 is defined. The output of the monostable multivibrator 27 is input through the integrating constant setting device 28, and the first and second integrating circuits 29 and 30 into the summing circuit 32. The outputs from the initial value setting device 31 and the proportional constant setting device 23 are also input into the summing circuit 32, by which the valve opening intervals for the actuator 6 are defined. The output from the summing circuit 32 is amplified by the amplifier 33 and input into the actuator 6. The actuator 6 is controlled so that when the output from the $O_2$ sensor 3 is higher in value than the reference voltage $V_{R1}$, the amount of additional fuel being injected from the actuator 6 into the intake passage is decreased, and; when the output from the $O_2$ sensor 3 is lower in value than the reference voltage $V_{R1}$, the amount of additional fuel is increased. As a result, the air-fuel ratio of the mixture will be kept in the vicinity of the stoichiometric air-fuel ratio.

On the other hand, during accelerating engine operating conditions, the output from the $O_2$ sensor 3 is compared with the accelerating reference voltage $V_{R2}$ in the comparative circuit 22, which generates a high level signal when the output from the $O_2$ sensor 3 is higher in value than the accelerating reference voltage $V_{R2}$, and generates a low level signal when the output from the $O_2$ sensor 3 is lower in value than the accelerating reference voltage $V_{R2}$. In the control circuit 4 illustrated in FIG. 2, the same operation as described above is performed. The actuator 6 is controlled so that when the output from the $O_2$ sensor 3 is higher in value than the accelerating reference voltage $V_{R2}$, the amount of additional fuel being injected into the intake passage is decreased, and when the output from the $O_2$ sensor 3 is lower than the accelerating voltage $V_{R2}$, the amount of additional fuel is increased.

Since $V_{R2}$ is higher in value than $V_{R1}$, during accelerating engine operating conditions, the air-fuel ratio of the mixture being controlled is changed so as to be richer than that under normal engine operating conditions. According to the present invention, it is possible to compensate for the gap between the actual air-fuel ratio and the stoichiometric air-fuel ratio during accelerating operating conditions and to prevent the air-fuel ratio from becoming a lean air-fuel ratio which would be caused by a time delay in the response in the feedback air-fuel control system during accelerating engine operating conditions, and it is also possible to keep the total air-fuel ratio in the vicinity of the stoichiometric air-fuel ratio during all engine operating conditions.

Therefore, when the air-fuel ratio control device of this invention is used, the efficiency of purification for noxious components, especially CO, HC and $NO_x$, contained in exhaust gas can be improved. In addition, if an air-fuel ratio control device having an EGR system is used, the operative efficiency of the engine is also improved during accelerating operating conditions.

What we claim is:

1. An air-fuel ratio control device for an internal combustion engine comprising:

a first sensor provided in an exhaust passage for detecting the oxygen concentration of exhaust gas;

a control circuit having means for comparing the output voltage from said first sensor with a reference voltage so that an air-fuel ratio of the mixture being introduced into the internal combustion engine is discriminated as rich or lean with respect to stoichiometric air-fuel ratio during all operating conditions of the engine;

means for supplying fuel into an intake passage of the internal combustion engine, so that when the air-fuel ratio of the mixture is leaner than the stoichimetric air-fuel ratio the amount of fuel is increased and when the air-fuel ratio of the mixture is richer than the stoichiometric air-fuel ratio the amount of fuel is decreased;

a second sensor for detecting the accelerating operating conditions of the internal combustion engine, said second sensor having an output signal indicating engine acceleration and comprising a diaphragm-type switch having a diaphragm which is actuated by vacuum pressure drawn from the intake passage downstream of a throttle valve, said diaphragm-type switch sends an accelerating signal to the control circuit when the absolute value of intake pressure is abruptly increased; and means, responsive to said output signal, for changing said reference voltage to a value different from a predetermined value so that the air-fuel ratio of the mixture being controlled is changed so as to be richer only when the internal combustion engine is in the accelerating operating conditions.

2. An air-fuel ratio control device as set forth in claim 1, wherein said first sensor for detecting the oxygen concentration of exhaust gas is an $O_2$ sensor.

3. An air-fuel ratio control device as set forth in claim 1, wherein said comparing means of the control circuit comprises: a comparator to which the output voltage of the first sensor and the reference voltage are input, and; a variable resistance for changing said reference voltage being input into said comparator, the resistance value of said variable resistance being changed by said reference voltage changing means.

4. An air-fuel ratio control device as set forth in claim 1, wherein said comparing means of the control circuit comprises a first comparator to which a reference voltage ($V_{R1}$) for ordinary conditions is input and a second comparator to which a reference voltage ($V_{R2}$) for accelerating conditions different from $V_{R1}$ is input, and said reference voltage changing means selects one of said first and second comparators.

* * * * *